US005458701A

United States Patent [19]

Kampe et al.

[11] Patent Number: 5,458,701

[45] Date of Patent: Oct. 17, 1995

[54] CR AND MN, BEARING GAMMA TITANIUM ALUMINIDES HAVING SECOND PHASE DISPERSOIDS

[75] Inventors: Stephen L. Kampe, Laurel; Leontios Christodoulou, Baltimore, both of Md.; Donald E. Larsen, Jr., Muskegon, Mich.

[73] Assignees: Howmet Corporation, Greenwich, Conn.; Martin Marietta Corporation, Bethesda, Md.

[21] Appl. No.: 161,323

[22] Filed: Dec. 2, 1993

Related U.S. Application Data

[62] Division of Ser. No. 716,951, Jun. 18, 1991, Pat. No. 5,354,351.

[51] Int. Cl.[6] ..... C22C 14/00

[52] U.S. Cl. ..... 148/421; 420/418; 420/421; 420/590

[58] Field of Search ..... 148/421; 420/590, 420/418, 421

[56] References Cited

U.S. PATENT DOCUMENTS

| | | | |
|---|---|---|---|
| 3,203,794 | 8/1965 | Jaffee et al. | 75/175.5 |
| 4,294,615 | 10/1981 | Blackburn et al. | 75/175.5 |
| 4,661,316 | 4/1987 | Hashimoto et al. | 420/418 |
| 4,710,348 | 12/1987 | Brupbacher et al. | 420/129 |
| 4,751,048 | 6/1988 | Christodoulou et al. | 420/129 |
| 4,772,452 | 9/1988 | Brupbacher et al. | 420/129 |
| 4,774,052 | 9/1988 | Nagle et al. | 420/129 |
| 4,800,065 | 1/1989 | Christodoulou et al. | 420/129 |
| 4,836,982 | 6/1989 | Brupbacher et al. | 420/129 |
| 4,836,983 | 6/1989 | Huang et al. | 420/418 |
| 4,842,817 | 6/1989 | Huang et al. | 420/418 |
| 4,842,819 | 6/1989 | Huang et al. | 420/418 |
| 4,842,820 | 6/1989 | Huang et al. | 420/418 |
| 4,857,268 | 8/1989 | Huang et al. | 420/418 |
| 4,879,092 | 11/1989 | Huang | 420/418 |
| 4,897,127 | 1/1990 | Huang | 148/133 |
| 4,902,474 | 2/1990 | Huang et al. | 420/418 |
| 4,915,902 | 4/1990 | Brupbacher et al. | 420/129 |
| 4,915,903 | 4/1990 | Brupbacher et al. | 420/129 |
| 4,915,905 | 4/1990 | Kampe et al. | 420/418 |
| 4,915,908 | 4/1990 | Nagel et al. | 420/590 |
| 4,916,028 | 4/1990 | Huang | 428/614 |
| 4,916,029 | 4/1990 | Nagle et al. | 428/614 |
| 4,916,030 | 4/1990 | Christodoulou et al. | 428/614 |
| 4,917,964 | 4/1990 | Moshier et al. | 428/614 |
| 5,256,202 | 10/1993 | Hanamura et al. | 420/418 |
| 5,284,620 | 2/1994 | Larsen, Jr. | 148/670 |
| 5,286,443 | 2/1994 | Nazmy et al. | 148/421 |

FOREIGN PATENT DOCUMENTS

| | | | |
|---|---|---|---|
| 220571 | 7/1957 | Australia . | |
| 0198639 | 2/1989 | Japan | C22C 14/00 |

OTHER PUBLICATIONS

T. Tsujimoto, Research, Development, and Prospects of TiAl Intermetallic Compound Alloys, Titanium and Zirconium, vol. 33, No. 3, pp. 7–17, 1985.

Whang et al, Effect of Rapid Solidification in $L1_0$ TiAl Compound Alloys, Materials Week, 1986.

*Primary Examiner*—Upendra Roy

*Attorney, Agent, or Firm*—Edward J. Timmer

[57] ABSTRACT

An article comprises a Cr-bearing, predominantly gamma titanium aluminide matrix including second phase dispersoids, such as $TiB_2$, in an amount effective to increase both the strength and the ductility of the matrix.

2 Claims, 10 Drawing Sheets

FIG. 7A
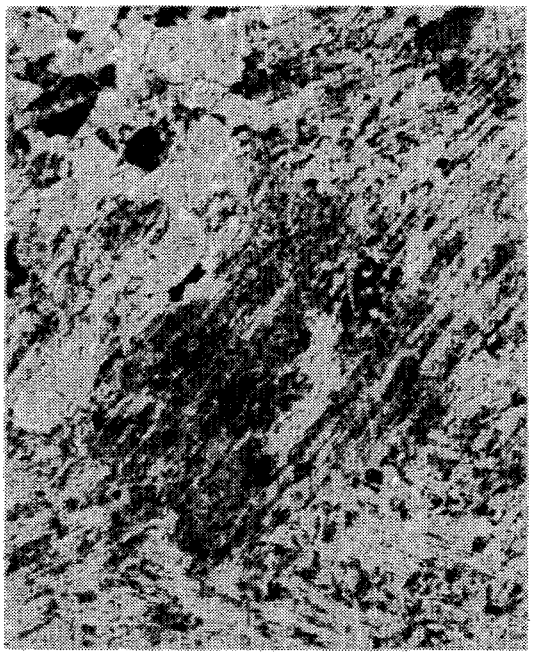
FIG. 7B
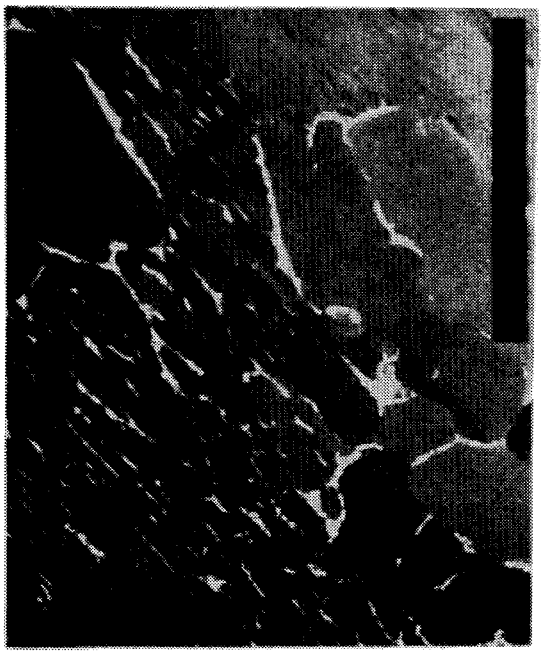
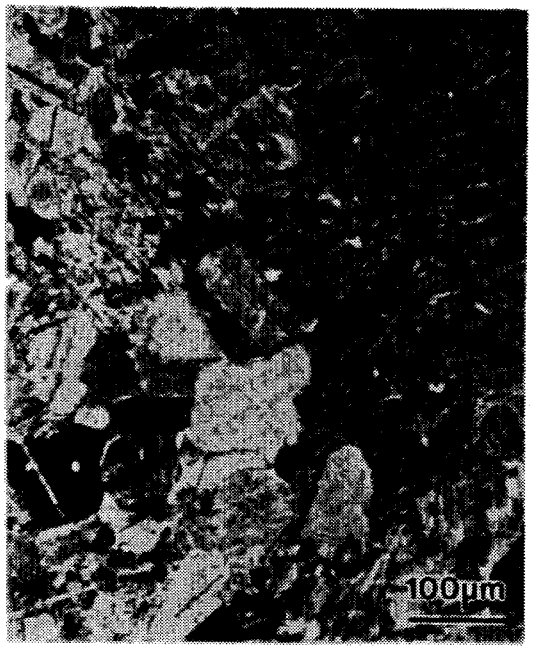
FIG. 7C
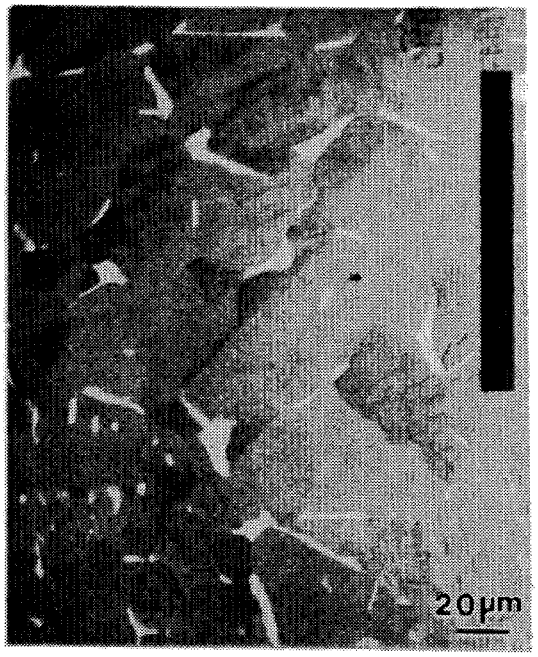
FIG. 7D

FIG. 8A
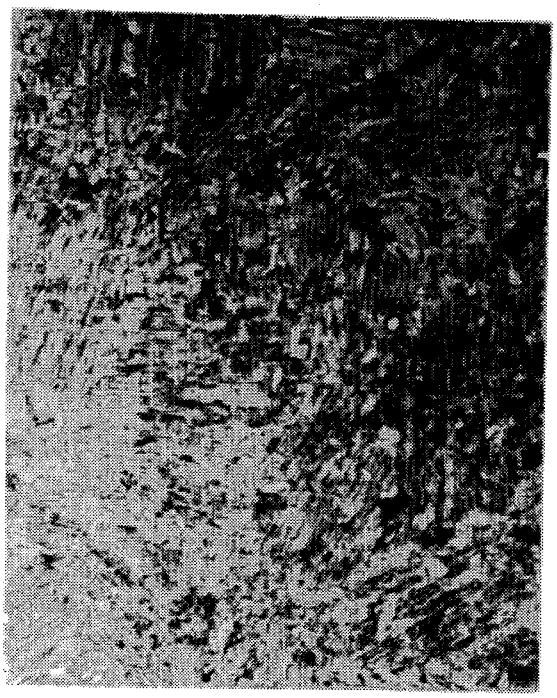
FIG. 8B
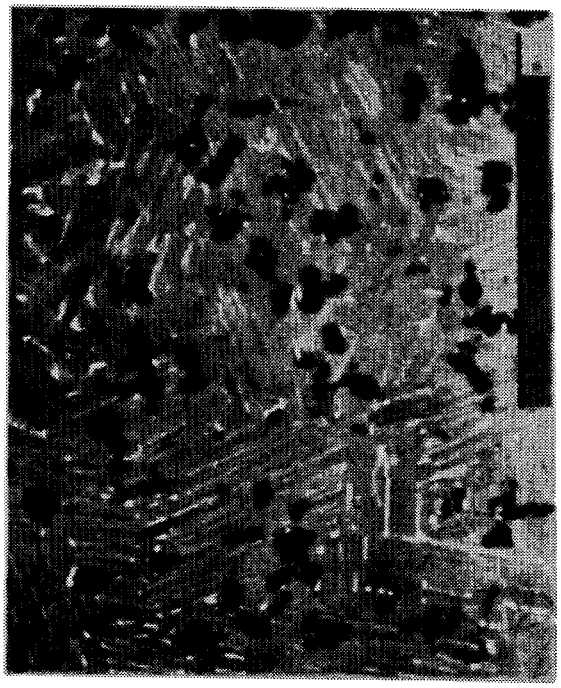
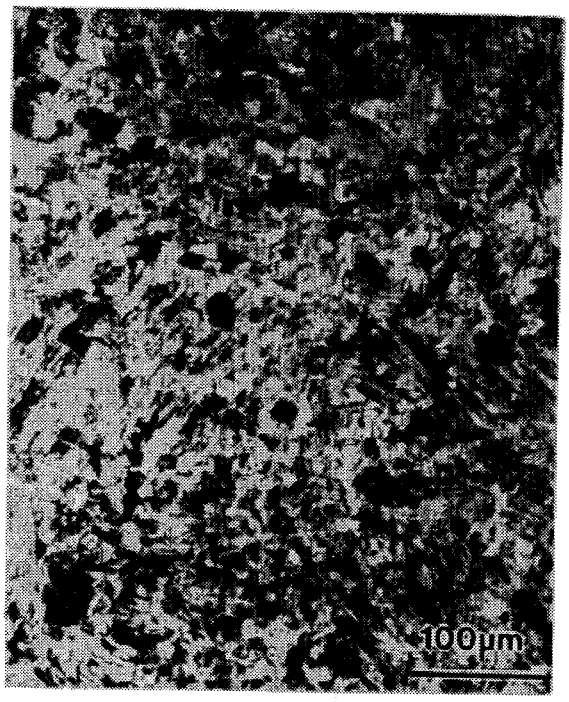
FIG. 8C
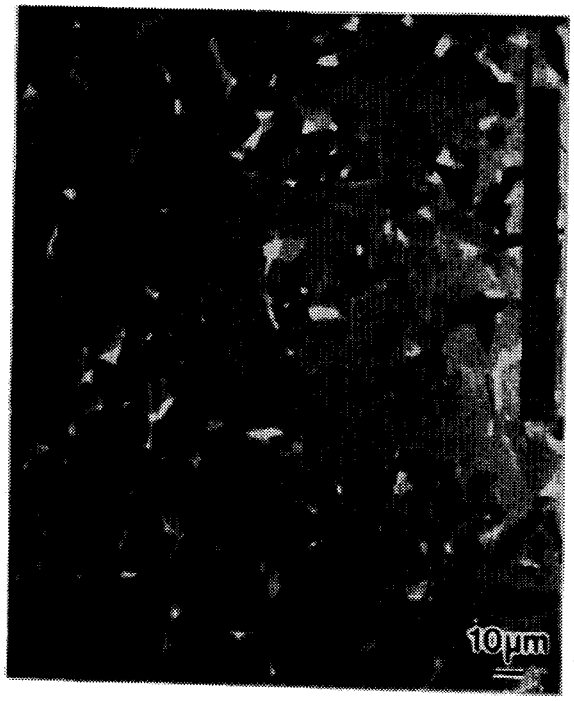
FIG. 8D

CR AND MN, BEARING GAMMA TITANIUM ALUMINIDES HAVING SECOND PHASE DISPERSOIDS

This is a division of application Ser. No. 07/716,951, filed Jun. 18, 1991, now U.S. Pat. No. 5,354,351.

FIELD OF THE INVENTION

The present invention relates to alloys of titanium and aluminum and, more particularly, to Cr-bearing, predominantly gamma titanium aluminides that exhibit an increase in both strength and ductility upon inclusion of second phase dispersoids therein.

BACKGROUND OF THE INVENTION

For the past several years, extensive research has been devoted to the development of intermetallic materials, such as titanium aluminides, for use in the manufacture of light weight structural components capable of withstanding high temperatures/stresses. Such components are represented, for example, by blades, vanes, disks, shafts, casings, and other components of the turbine section of modern gas turbine engines where higher gas and resultant component temperatures are desired to increase engine thrust/efficiency or other applications requiring lightweight high temperature materials.

Intermetallic materials, such as gamma titanium aluminide, exhibit improved high temperature mechanical properties, including high strength-to-weight ratios, and oxidation resistance relative to conventional high temperature titanium alloys. However, general exploitation of these intermetallic materials has been limited by the lack of strength, room temperature ductility and toughness, as well as the technical challenges associated with processing and fabricating the material into the complex end-use shapes that are exemplified, for example, by the aforementioned turbine components.

The Kampe et al U.S. Pat. No. 4,915,905 issued Apr. 10, 1990 describes in detail the development of various metallurgical processing techniques for improving the low (room) temperature ductility and toughness of intermetallic materials and increasing their high temperature strength. The Kampe et al '905 patent relates to the rapid solidification of metallic matrix composites. In particular, in this patent, an intermetallic-second phase composite is formed; for example, by reacting second phase-forming constituents in the presence of a solvent metal, to form in-situ precipitated second phase particles, such as boride dispersoids, within an intermetallic-containing matrix, such as titanium aluminide. The intermetallic-second phase composite is then subjected to rapid solidification to produce a rapidly solidified composite. Thus, for example, a composite comprising in-situ precipitated $TiB_2$ particles within a titanium aluminide matrix may be formed and then rapidly solidified to produce a rapidly solidified powder of the composite. The powder is then consolidated by such consolidation techniques as hot isostatic pressing, hot extrusion and superplastic forging to provide near-final (i.e., near-net) shapes.

U.S. Pat. No. 4,836,982 to Brupbacher et al also relates to the rapid solidification of metal matrix composites wherein second phase-forming constituents are reacted in the presence of a solvent metal to form in-situ precipitated second phase particles, such as $TiB_2$ or TiC, within the solvent metal, such as aluminum.

U.S. Pat. Nos. 4,774,052 and 4,916,029 to Nagle et al are specifically directed toward the production of metal matrix-second phase composites in which the metallic matrix comprises an intermetallic material, such as titanium aluminide. In one embodiment, a first composite is formed which comprises a dispersion of second phase particles, such as $TiB_2$, within a metal or alloy matrix, such as Al. This composite is then introduced into an additional metal which is reactive with the matrix to form an intermetallic matrix. For example, a first composite comprising a dispersion of $TiB_2$ particles within an Al matrix may be introduced into molten titanium to form a final composite comprising $TiB_2$ dispersed within a titanium aluminide matrix. U.S. Pat. No. 4,915,903 to Brupbacher et al describes a modification of the methods taught in the aforementioned Nagle et al patents.

U.S. Pat. Nos. 4,751,048 and 4,916,030 to Christodalou et al relate to the production of metal matrix-second phase composites wherein a first composite which comprises second phase particles dispersed in a metal matrix is diluted in an additional amount of metal to form a final composite of lower second phase loading. For example, a first composite comprising a dispersion of $TiB_2$ particles within an Al matrix may be introduced into molten titanium to form a final composite comprising $TiB_2$ dispersed within a titanium aluminide matrix.

U.S. Pat. No. 3,203,794 to Jaffee et al relates to gamma TiAl alloys which are said to maintain hardness and resistance to oxidation at elevated temperatures. The use of alloying additions such as In, Bi, Pb, Sn, Sb, Ag, C, O, Mo, V, Nb, Ta, Zr, Mn, Cr, Fe, W, Co, Ni, Cu, Si, Be, B, Ce, As, S, Te and P is disclosed. However, such additions are said to lower the ductility of the TiAl binary alloys.

An attempt to improve room temperature ductility by alloying intermetallic materials with one or more metals in combination with certain plastic forming techniques is disclosed in the Blackburn U.S. Pat. No. 4,294,615 wherein vanadium was added to a TiAl composition to yield a modified composition of Ti-31 to 36% Al-0 to 4% V (percentages by weight). The modified composition was melted and isothermally forged to shape in a heated die at a slow deformation rate necessitated by the dependency of ductility of the intermetallic material on strain rate. The isothermal forging process is carried out at above 1000° C. such that special die materials (e.g., a Mo alloy known as TZM) must be used. Generally, it is extremely difficult to process TiAl intermetallic materials in this way as a result of their high temperature properties and the dependence of their ductility on strain rate.

A series of U.S. patents comprising U.S. Pat. Nos. 4,836,983; 4,842,817; 4,842,819; 4,842,820; 4,857,268; 4,879,092; 4,897,127; 4,902,474; and 4,916,028, have described attempts to make gamma TiAl intermetallic materials having both a modified stoichiometric ratio of Ti/Al and one or more alloyant additions to improve room temperature strength and ductility. The addition of Cr alone or with Nb, or with Nb and C, is described in the '819; '092 and '028 patents. In making cylindrical shapes from these modified compositions, the alloy was typically first made into an ingot by electro-arc melting. The ingot was melted and melt spun to form rapidly solidified ribbon. The ribbon was placed in a suitable container and hot isostatically pressed (HIP'ped) to form a consolidated cylindrical plug. The plug was placed axially into a central opening of a billet and sealed therein. The billet was heated to 975° C. for 3 hours and extruded through a die to provide a reduction of about 7 to 1. Samples from the extruded plug were removed from the billet and heat treated and aged.

U.S. Pat. No. 4,916,028 (included in the series of patents listed above) also refers to processing the TiAl base alloys as modified to include C, Cr and Nb additions by ingot metallurgy to achieve desirable combinations of ductility, strength and other properties at a lower processing cost than the aforementioned rapid solidification approach. In particular, the ingot metallurgy approach described in the '028 patent involves melting the modified alloy and solidifying it into a hockey puck-shaped ingot of simple geometry and small size (e.g., 2 inches in diameter and 0.5 inch thick), homogenizing the ingot at 1250° C. for 2 hours, enclosing the ingot in a steel annulus, and then hot forging the annulus/ring assembly to provide a 50% reduction in ingot thickness. Tensile specimens cut from the ingot were annealed at various temperatures above 1225° C. prior to tensile testing. Tensile specimens prepared by this ingot metallurgy approach exhibited lower yield strengths but greater ductility than specimens prepared by the rapid solidification approach.

Despite the attempts described hereabove to improve the ductility and strength of intermetallic materials, there is a continuing desire and need in the high performance material-using industries, especially in the gas turbine engine industry, for intermetallic materials which have improved properties or combinations of properties and which are amenable to fabrication into usable, complex engineered end-use shapes on a relatively high volume basis at a relatively low cost. It is an object of the present invention to satisfy these desires and needs.

SUMMARY OF THE INVENTION

In one embodiment, the present invention involves a titanium aluminide article, as well as method of making the article, wherein both the strength and ductility thereof can be increased by virtue of the inclusion of second phase dispersoids in a Cr-bearing, predominantly gamma titanium aluminide matrix. To this end, second phase dispersoids, such as, for example, $TiB_2$, in an amount of about 0.5 to about 20.0 volume %, preferably about 0.5 to about 7.0 volume %, are included in a predominantly gamma titanium aluminide matrix including from about 0.5 to about 5.0 atomic % Cr, preferably from about 1.0 to about 3.0 atomic % Cr.

In another embodiment, the invention involves a titanium aluminum alloy consisting essentially of (in atomic %) about 40 to about 52% Ti, about 44 to about 52% Al, about 0.5 to about 5.0% Mn, and about 0.5 about 5.0% Cr. A preferred alloy consists essentially of (in atomic %) about 41 to about 50% Ti, about 46% to 49% Al, about 1% to about 3% Mn, about 1% to about 3% Cr, up to about 3% V and up to about 3% Nb. Second phase dispersoids may be included in the alloy in an amount of about 0.5 to about 20.0 volume % to increase strength. Unexpectedly, the titanium aluminide alloy exhibits an increase in ductility as well as strength upon the inclusion of the second phase dispersoids therein.

BRIEF DESCRIPTION OF THE DRAWINGS

FIGS. 7*a*, 7*b* and 7*c*, 7*d* illustrate the effect of heat treatment at 1650° F. for 50 hours and 2012° F. for 16 hours, respectively, on microstructure of the Ti-48al-2Mn-2Cr alloy of the invention devoid of $TiB_2$ dispersoids.

FIGS. 8*a*, 8*b* and 8*c*, 8*d* illustrate the effect of heat treatment at 1650° F. for 50 hours and 2012° F. for 16 hours, respectively, on microstructure of the Ti-48al-2Mn-2Cr alloy of the invention including 7 volume % $TiB_2$ dispersoids.

DETAILED DESCRIPTION OF THE INVENTION

Figure 1A:
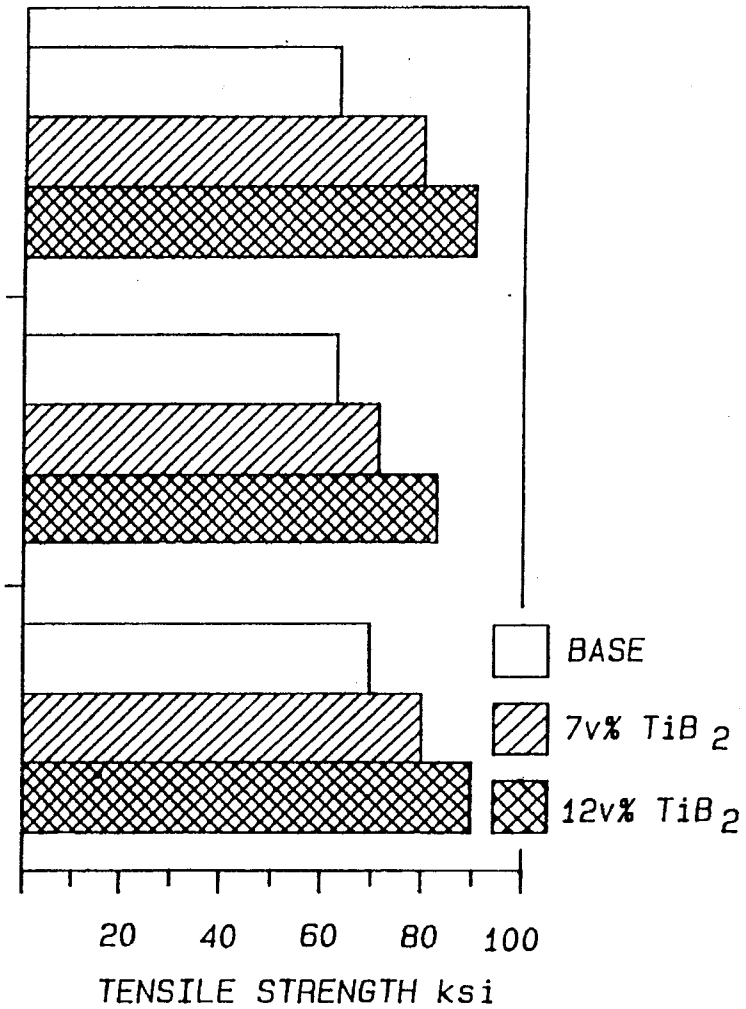
FIGS. 1*a* and 1*b* are bar graphs illustrating the change in strength and ductility of Cr-bearing, predominantly gamma titanium aluminide alloys of the invention upon the inclusion of titanium borides. Similar data is presented for a Ti-48Al-2V-2Mn alloy (reference alloy) to illustrate the increase in strength but the decrease in ductility observed upon inclusion of the same boride levels therein.

The present invention contemplates a titanium aluminide article including second phase dispersoids (e.g., $TiB_2$) in a Cr-bearing, predominantly gamma TiAl matrix in effective concentrations that result in an increase in both strength and ductility. In one embodiment of the invention, the alloy matrix consists essentially of, in atomic %, about 40 to about 52% Ti, about 44 to about 52% Al, about 0.5 to about 5.0% Mn and about 0.5 to about 5.0% Cr to this end. Preferably, the alloy matrix consists essentially of, in atomic %, about 41 to about 50% Ti, about 46 to about 49% Al, about 1 to about 3% Mn, about 1 to about 3% Cr, up to about 3% V, and up to about 3% Nb. The alloy matrix includes second phase dispersoids, such as preferably $TiB_2$, in an amount not exceeding about 20.0 volume %. Preferably, the second phase dispersoids are present in an amount of about 0.5 to about 12.0 volume %, more preferably from about 0.5 to about 7.0 volume %.

The matrix is considered predominantly gamma in that a majority of the matrix microstructure in the as-cast or the cast/hot isostatically pressed/heat treated condition described hereafter comprises gamma phase. Alpha 2 and beta phases can also be present in minor proportions of the matrix microstructure; e.g., from about 2 to about 15 volume % of alpha 2 phase and up to about 5 volume % beta phase can be present.

The following Table I lists nominal and measured Cr-bearing titanium-aluminum ingot compositions produced in accordance with exemplary embodiments of the present invention. Also listed are the nominal and measured ingot composition of a Ti-48Al -2V-2Mn alloy used as a reference alloy for comparison purposes.

TABLE 1

| Nominal Composition (atomic %) | Ti | Al | V | Mn | Cr | Nb | $O_2$ | C | $N_2$ | $TiB_2$[1] (v %) | Density[2] ($g/cm^3$) |
|---|---|---|---|---|---|---|---|---|---|---|---|
| Ti—48 Al—2 V—2 Mn | 49.0 | 47.1 | 2.0 | 1.9 | | | 0.062 | 0.009 | 0.012 | 0.0 | 3.955 |
| Ti—48 Al—2 V—2 Mn + 7.5 v % $TiB_2$ | 46.6 | 49.4 | 2.0 | 2.1 | | | 0.075 | 0.022 | 0.019 | 9.1 | 3.962 |
| Ti—48 Al—2 V—2 Mn + 12.0 v % $TiB_2$ | 46.2 | 50.0 | 1.9 | 1.8 | | | 0.073 | 0.028 | 0.024 | 17.0 | 4.002 |
| Ti—48 Al—2 V—2 Mn—Cr | 47.4 | 47.0 | 2.0 | 1.8 | 1.8 | | 0.099 | 0.010 | 0.010 | 0.0 | 3.980 |
| Ti—48 Al—2 V—2 Mn—2 Cr + 7.5 v % $TiB_2$ | 47.3 | 46.6 | 2.0 | 2.0 | 2.1 | | 0.086 | 0.014 | 0.016 | 7.1 | 4.033 |
| Ti—48 Al—2 V—2 Mn—2 CR + 12.0 v % $TiB_2$ | 46.0 | 48.3 | 1.7 | 2.3 | 1.6 | | 0.084 | 0.027 | 0.023 | 12.1 | 4.012 |
| Ti—48 Al—2 Mn—Cr | 49.3 | 46.9 | | 2.0 | 1.8 | | 0.118 | 0.016 | 0.010 | 0.0 | 3.968 |
| Ti—48 Al—2 Mn—2 Cr + 7.5 v % $TiB_2$ | 50.1 | 46.2 | | 1.8 | 1.9 | | 0.128 | 0.014 | 0.013 | 6.0 | 3.998 |
| Ti—48 Al—2 Mn—2 Cr + 12.0 v % $TiB_2$ | 49.6 | 46.3 | | 2.0 | 2.0 | | 0.120 | 0.024 | 0.017 | 12.0 | 4.030 |
| Ti—47 Al—2 Mn—1 Nb—1 Cr | 49.1 | 47.0 | | 2.1 | 0.9 | 0.9 | 0.087 | 0.029 | 0.007 | 0.0 | |
| Ti—47 Al—2 Mn—1 Nb—1 Cr + 7 v % $TiB_2$ | 48.9 | 47.0 | | 2.0 | 1.0 | 1.1 | 0.090 | 0.015 | 0.011 | 7.0 | |

[1]TiB, percentage based on elemental boron.
[2]Density measured by Archimedes method.

The dispersoids of $TiB_2$ were provided in the ingots using a master sponge material comprising 70 weight % $TiB_2$ in an Al matrix and available from Martin Marietta Corp., Bethesda, Md. and its licensees. The master sponge material was introduced into a titanium aluminum melt of the appropriate composition prior to casting into an investment mold in accordance with U.S. Pat. Nos. 4,751,048 and 4,916,030, the teachings of which are incorporated herein by reference.

Segments of each ingot were sliced, remelted by a conventional vacuum arc remelting, to a superheat of +50° F. above the alloy melting temperature, and investment cast into preheated ceramic molds (600° F.) to form cast test bars having a diameter of 0.625 inch and a length of 6.0 inches. Each mold included a $Zr_2O_3$ facecoat and a plurality of $Al_2O_3/Zr_2O_3$ backup coats. Following casting and removal from the investment molds, all test bars were hot isostatically pressed (HIP'ed) at 25 ksi and 2300° F. for 4 hours in an inert atmosphere (Ar).

Baseline mechanical tensile data were obtained using the investment cast test bars which had been heat treated at 1650° F. (900° C.) for 16 hours following the aforementioned hot isostatic pressing operation. The $TiB_2$ dispersoids present in the cast/HIP'd/heat treated test bars typically had particle sizes (i.e., diameters) in the range of 0.3 to 5 microns.

The results of the tensile tests are shown in FIG. 1*a* plotted as a function of matrix alloy composition for 0, 7, and 12 volume % $TiB_2$. From FIG. 1*a*, it is apparent that the yield strength of all the alloys increases with the addition of 7 and 12 volume % $TiB_2$.

Figure 1B:
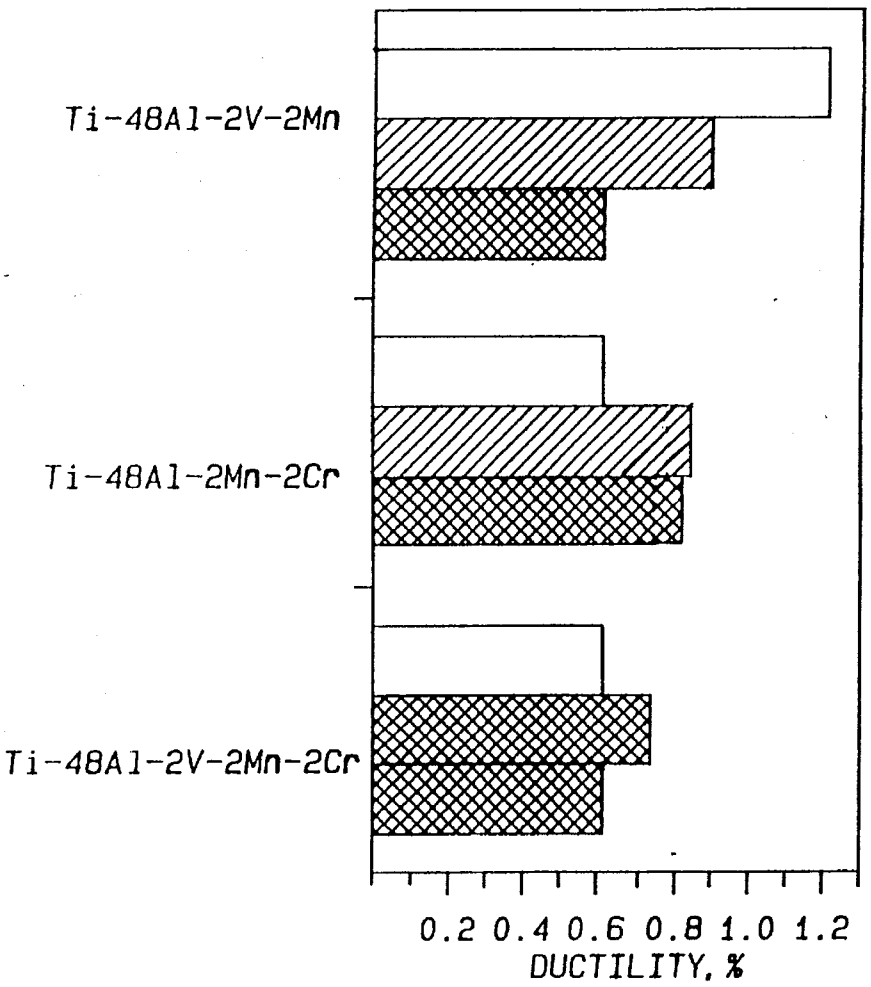

However, from FIG. 1*b*, the room temperature ductility of the Ti-48Al-2V-2Mn alloy was observed to decrease substantially with the addition of these levels of $TiB_2$ to the matrix alloy. Surprisingly, the ductility of the Cr-bearing alloys (i.e., Ti-48Al-2Mn-2Cr, Ti-48Al-2V-2Mn-2Cr and Ti-47Al-2Mn- 1Nb-1Cr) was observed to increase with the addition of these levels of $TiB_2$, especially upon the addition of 7 volume % $TiB_2$. Thus, for the TiAl alloys including chromium as an additional alloyant and $TiB_2$ dispersoids, both the strength and the ductility were found to increase unexpectedly.

Figure 2C:
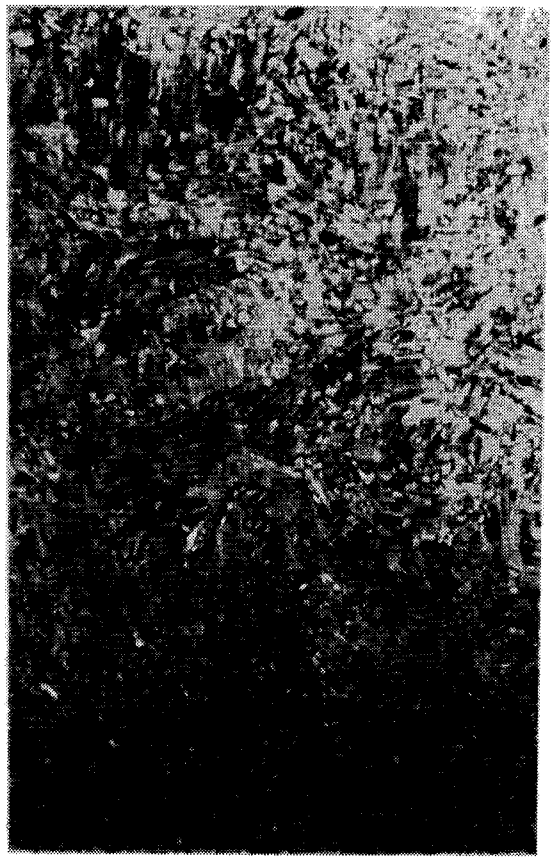
FIGS. 2*a*, 2*b*, and 2*c* illustrate the microstructure of the Ti-48Al-2V-2Mn reference alloy after hot isostatic pressing and heat treatment at 1650° F. (900° C.) for 16 hours.
Figure 2B:
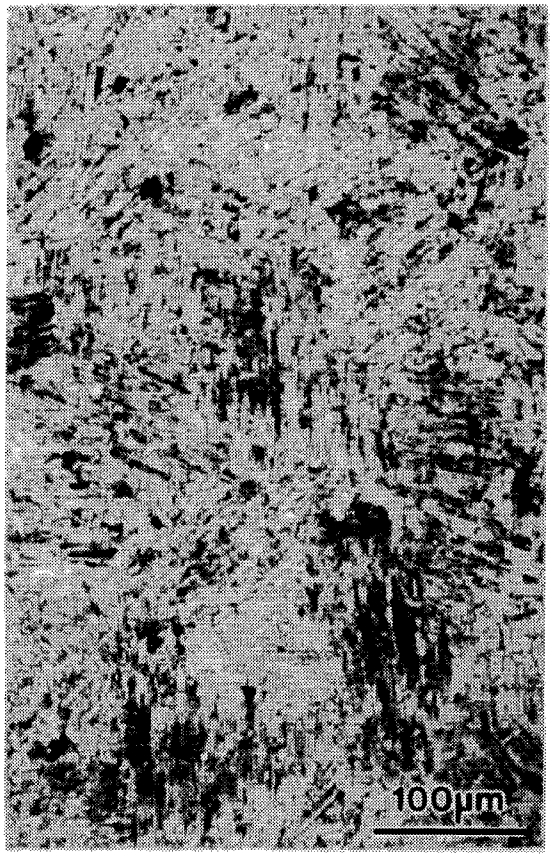
Figure 2A:
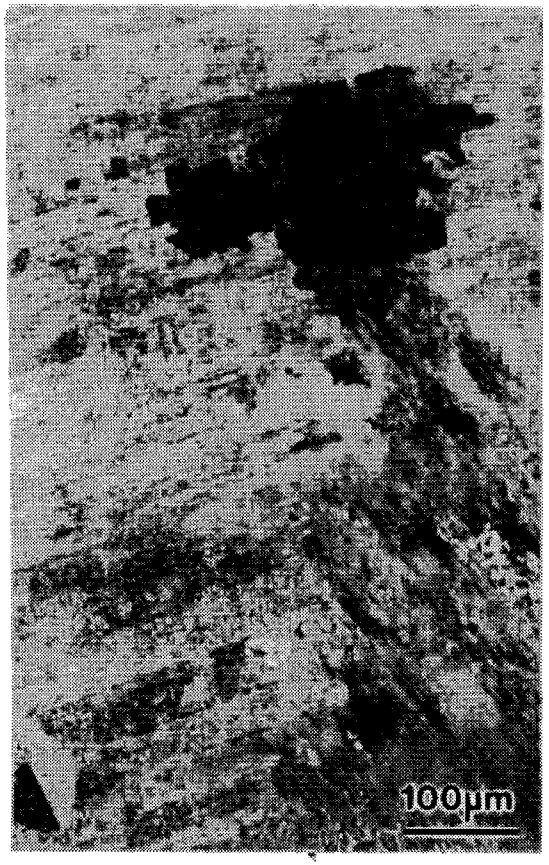
Figure 3C:
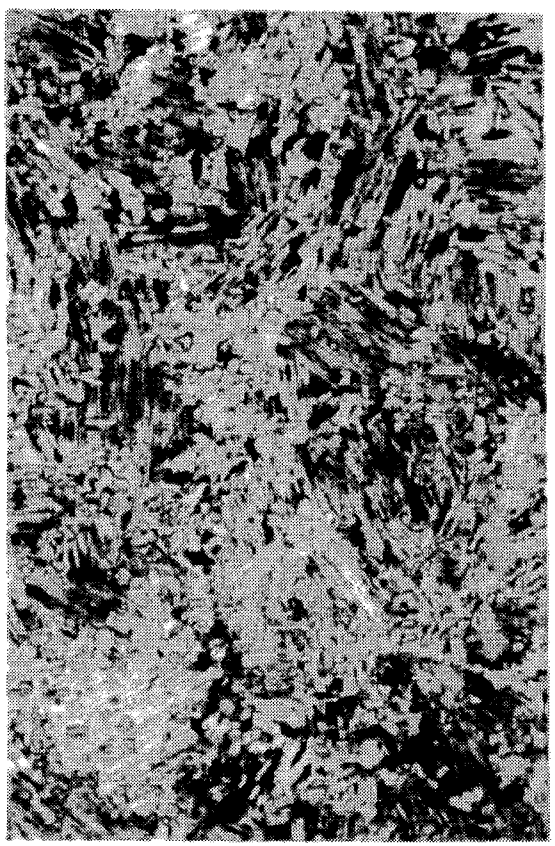
FIGS. 3*a*, 3*b* and 3*c* illustrate the microstructure of the Ti-48Al-2Mn-2Cr alloy of the invention after the same hot isostatic pressing and heat treatment as used in FIGS. 2*a*–2*c*.
Figure 3B:
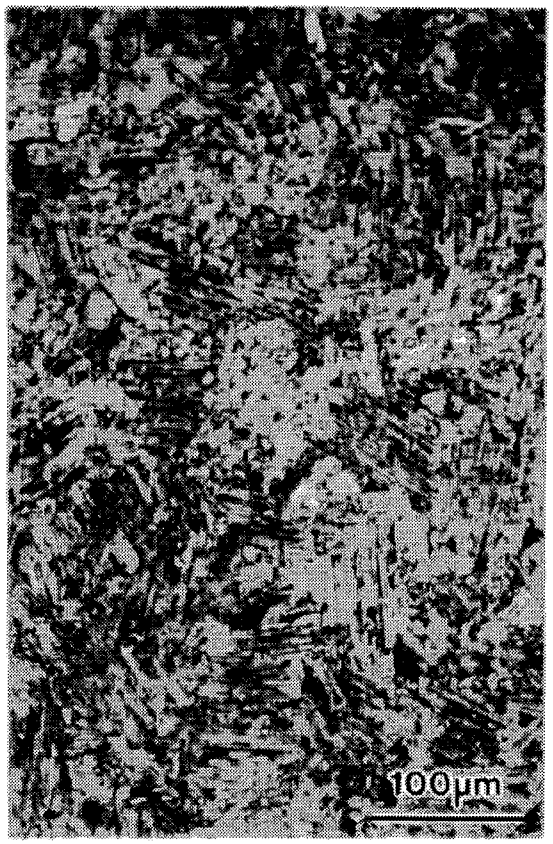
Figure 3A:
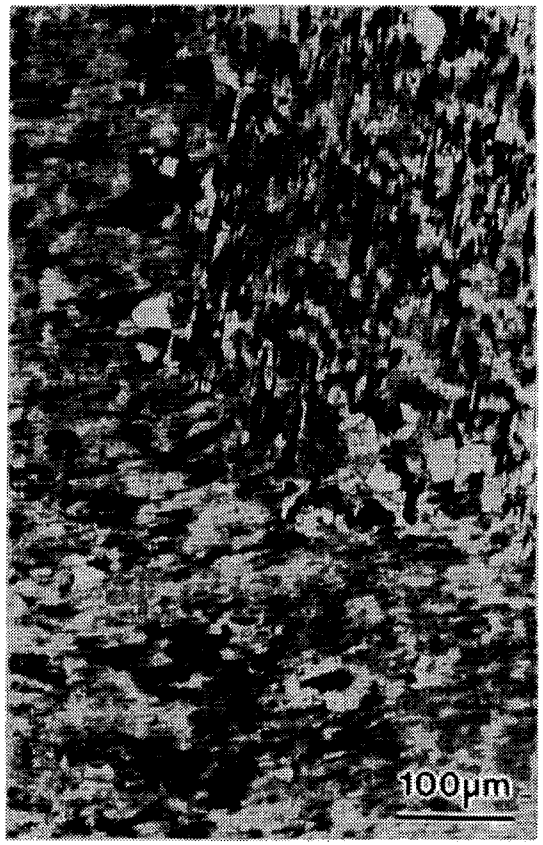
Figure 4C:
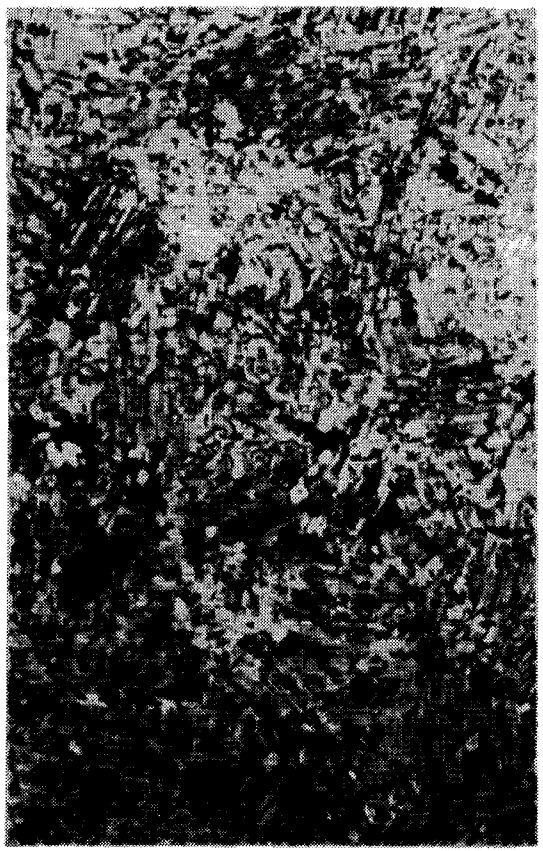
FIGS. 4*a*, 4*b* and 4*c* illustrate the microstructure of the Ti-48Al-2V-2Mn-2Cr alloy of the invention after the same hot isostatic pressing and heat treatment as used in FIGS. 2*a*–2*c*.
Figure 4B:
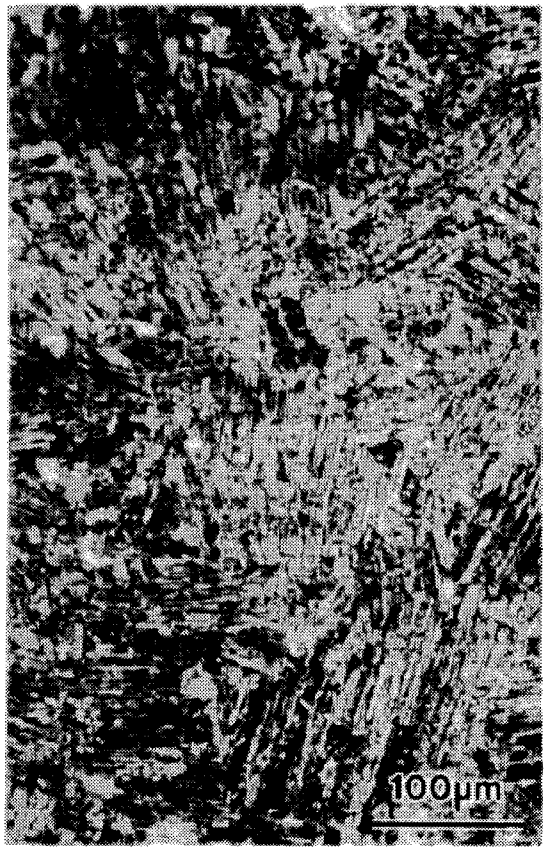
Figure 4A:
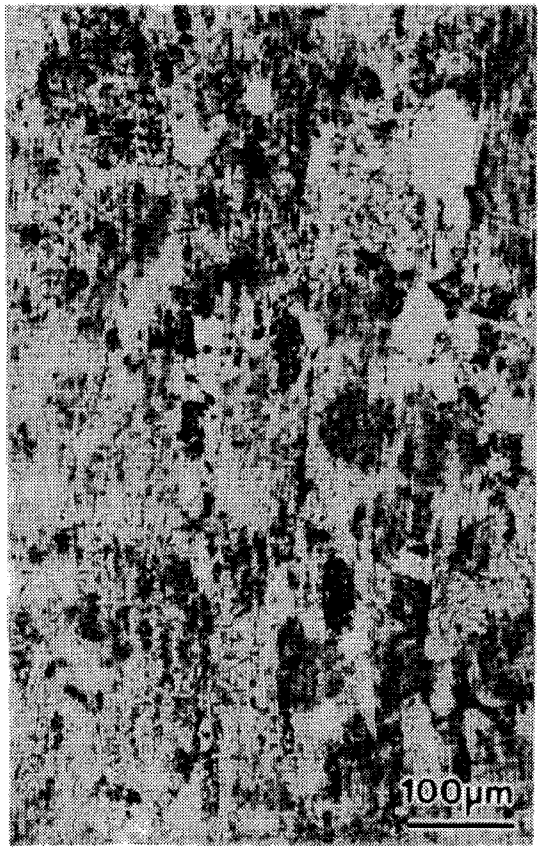
Figure 5A:
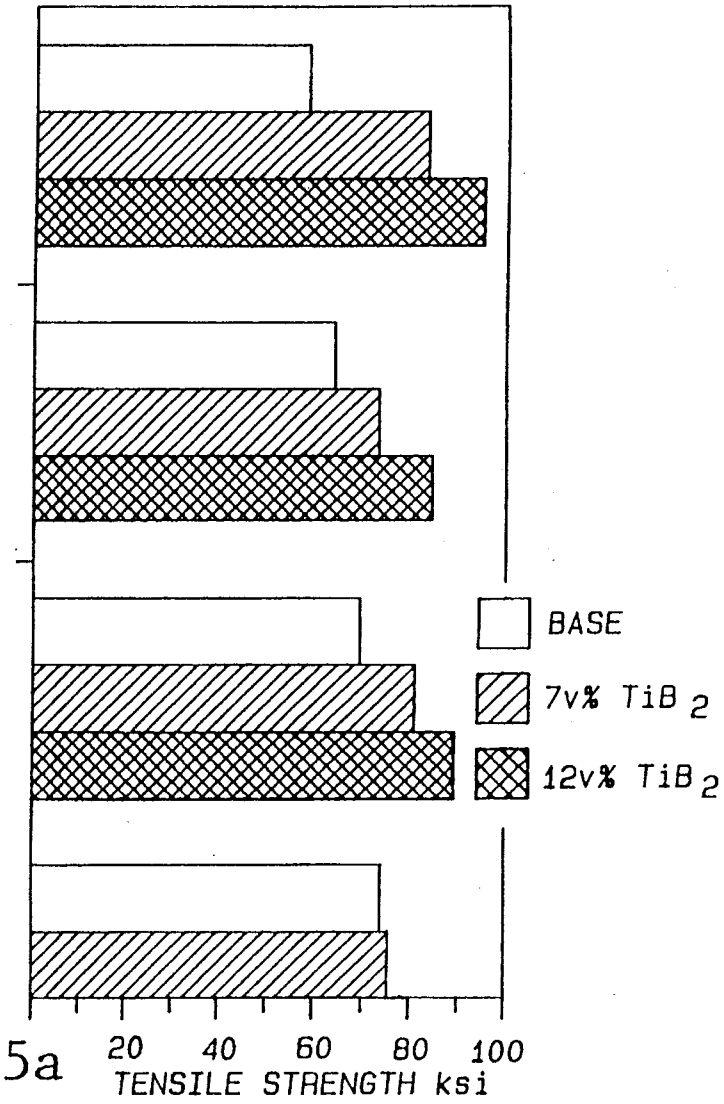
FIGS. 5*a*,5*b* and 6*a*,6*b* illustrate the change in strength and ductility of the aforementioned alloys of FIG. 1 after different heat treatments.
Figure 5B:
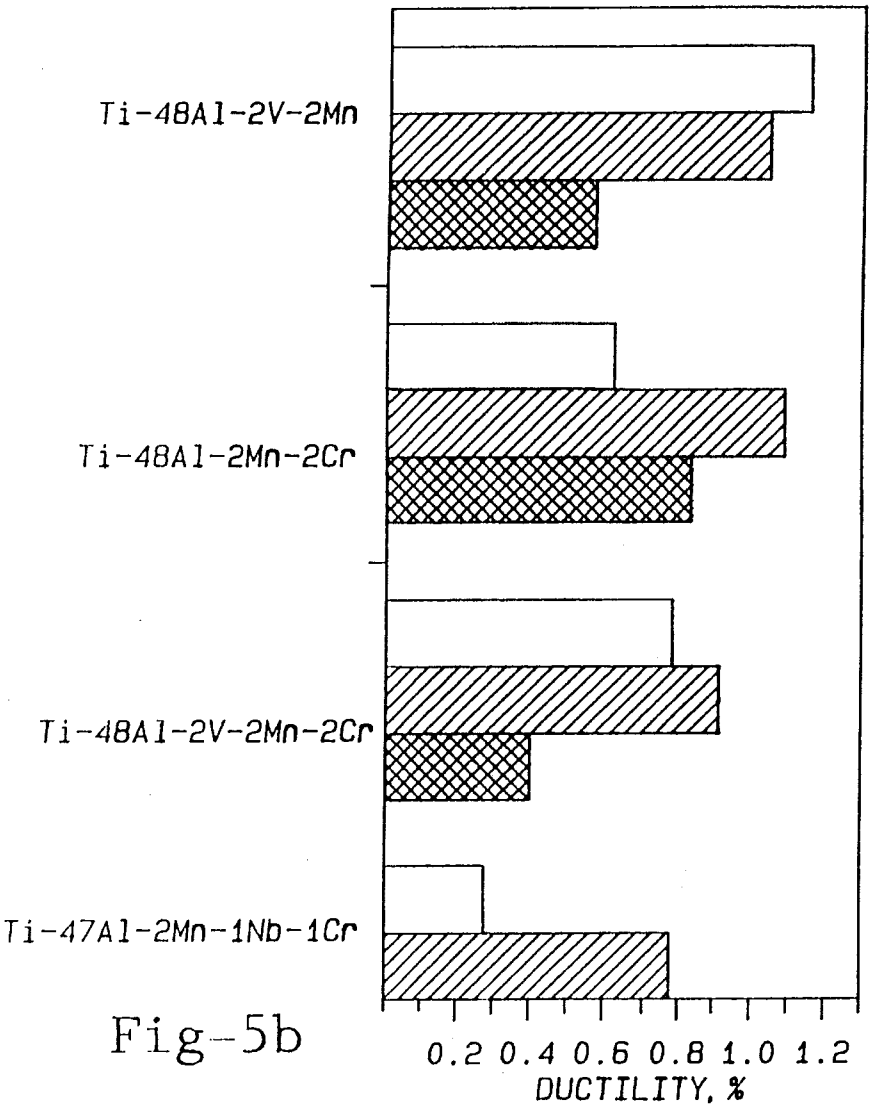

Representative optical microstructures of these alloys after casting, hot isostatic pressing, and heat treatment are shown in FIGS. 2*a*, 2*b*, 2*c*; 3*a*, 3*b*, and 3*c*; and 4*a*, 4*b*, and 4*c*. The photomicrographs illustrate that the microstructures of the alloys are predominantly lamellar (i.e., alternating lathes of gamma phase and alpha 2 phase) with some equiaxed grains residing at colony boundaries. Generally, there was little or no evidence of microstructural coarsening or other morphological transformations upon hot isostatic pressing and/or heat treatment.

Figure 6A:
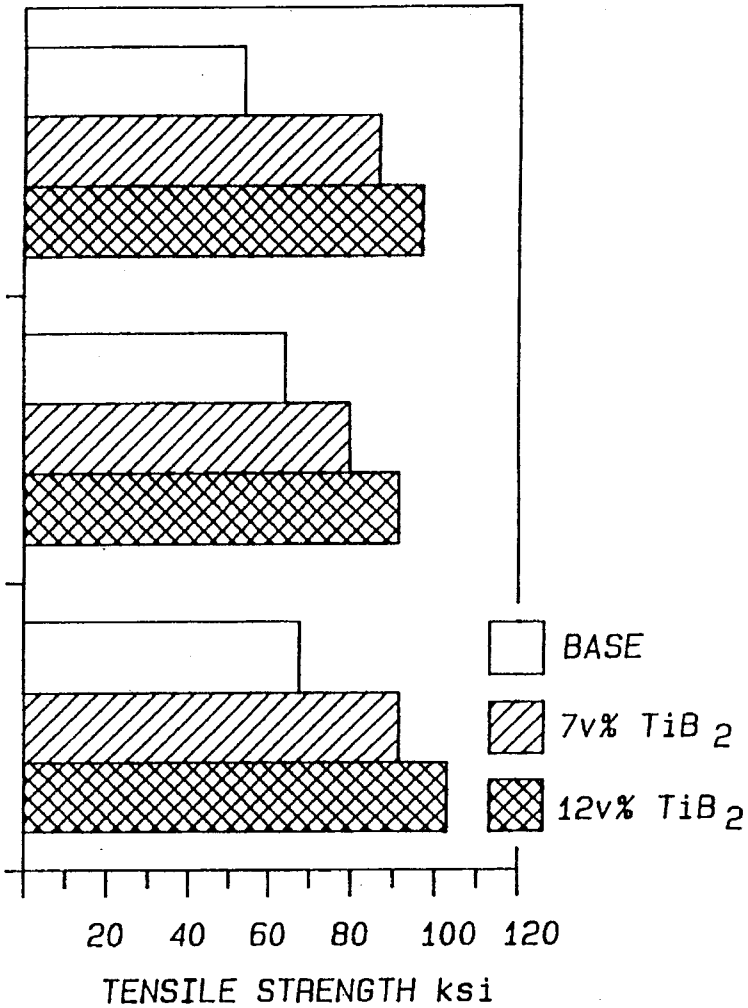
Figure 6B:
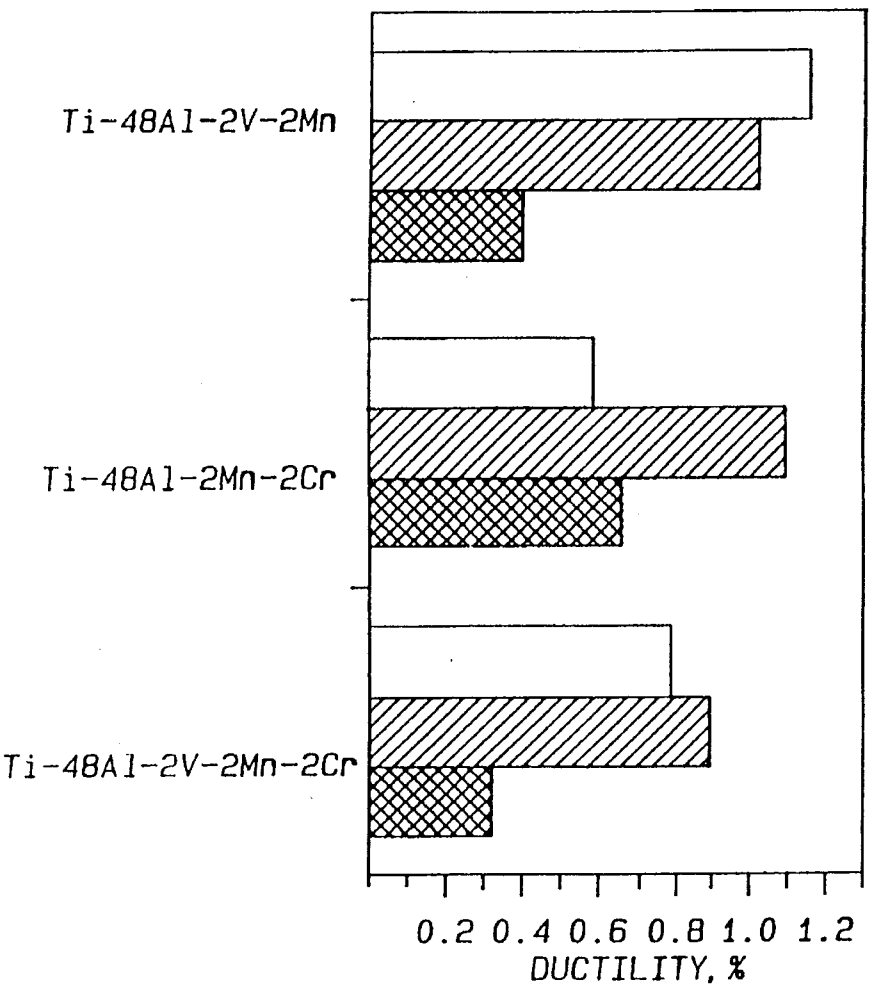

The effect of longer time or higher temperature heat treatments on alloy strength and ductility are illustrated in FIGS. 5*a*,5*b* and 6*a*, 6*b* for heat treatments at 900° C. (1650° F.) for 50 hours (FIGS. 5*a*,5*b*) and 1100° C. (2012° F.) for 16 hours (FIGS. 6*a*,6*b*). Yield strength is shown to increase with increasing percent $TiB_2$. Moreover, increases in ductility were again noted for the Cr-bearing test bars having 7 volume % $TiB_2$ in the matrix. In general, the 900° C. (1650° F.) heat treatments resulted in maximum ductility in all of the alloys shown. In the alloys of the invention containing 7 and 12 volume % $TiB_2$, maximum ductility occurred following heat treatment at 1650° F. for 50 hours. In general, strength was relatively insensitive to heat treatment.

FIGS. 7*a*,7*b* and 7*c*,7*d* illustrate the microstructures of alloy matrices following heat treatment at 1650° F. for 50 hours and 2012° F. for 16 hours, respectively, for the Ti-48Al-2Mn-2Cr devoid of $TiB_2$. FIGS. 8*a*,8*b* and 8*c*,8*d* illustrate the alloy matrix microstructure for the same alloy with 7 volume % $TiB_2$ after the same heat treatments. In the boride-free alloy, transformation of the matrix to a primarily equiaxed microstructure was observed after these heat treatments. On the other hand, the matrix microstructure including 7 volume % $TiB_2$ exhibited very little change after these heat treatments, retaining a primarily lamellar microstructure.

Figure 9:
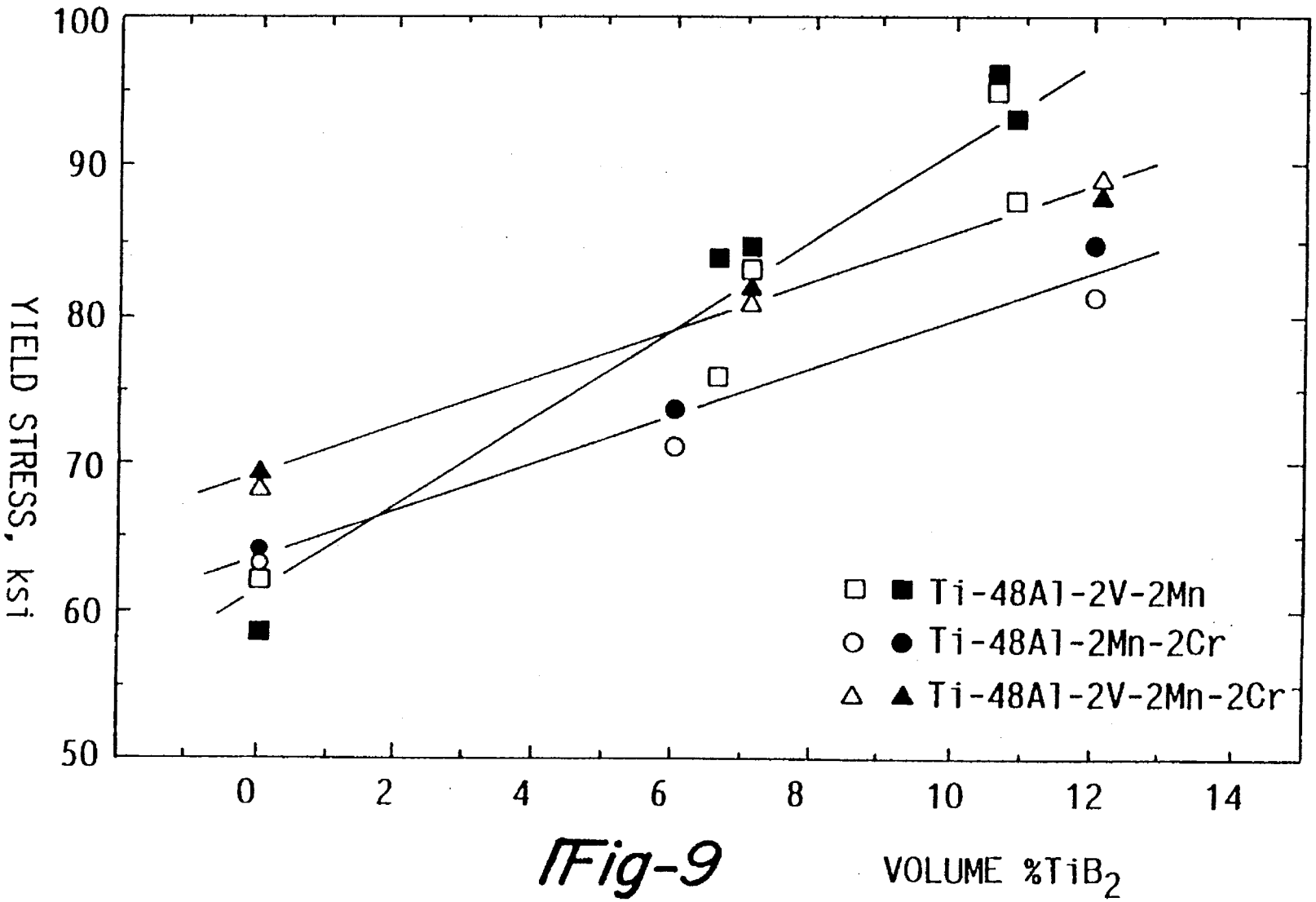
FIG. 9 illustrates the change in yield strength of the aforementioned alloys of FIG. 1 with the volume % of $TiB_2$ dispersoids.

FIG. 9 illustrates tensile yield strength as a function of dispersoid ($TiB_2$) loading for the aforementioned alloys heat treated at 1650° F. for 16 hours. All alloys exhibit approximately linear increases in strength with increasing dispersoid loading (volume %). The Ti-48Al-2V-2Mn alloy exhibited the strongest dependence.

Figure 10:
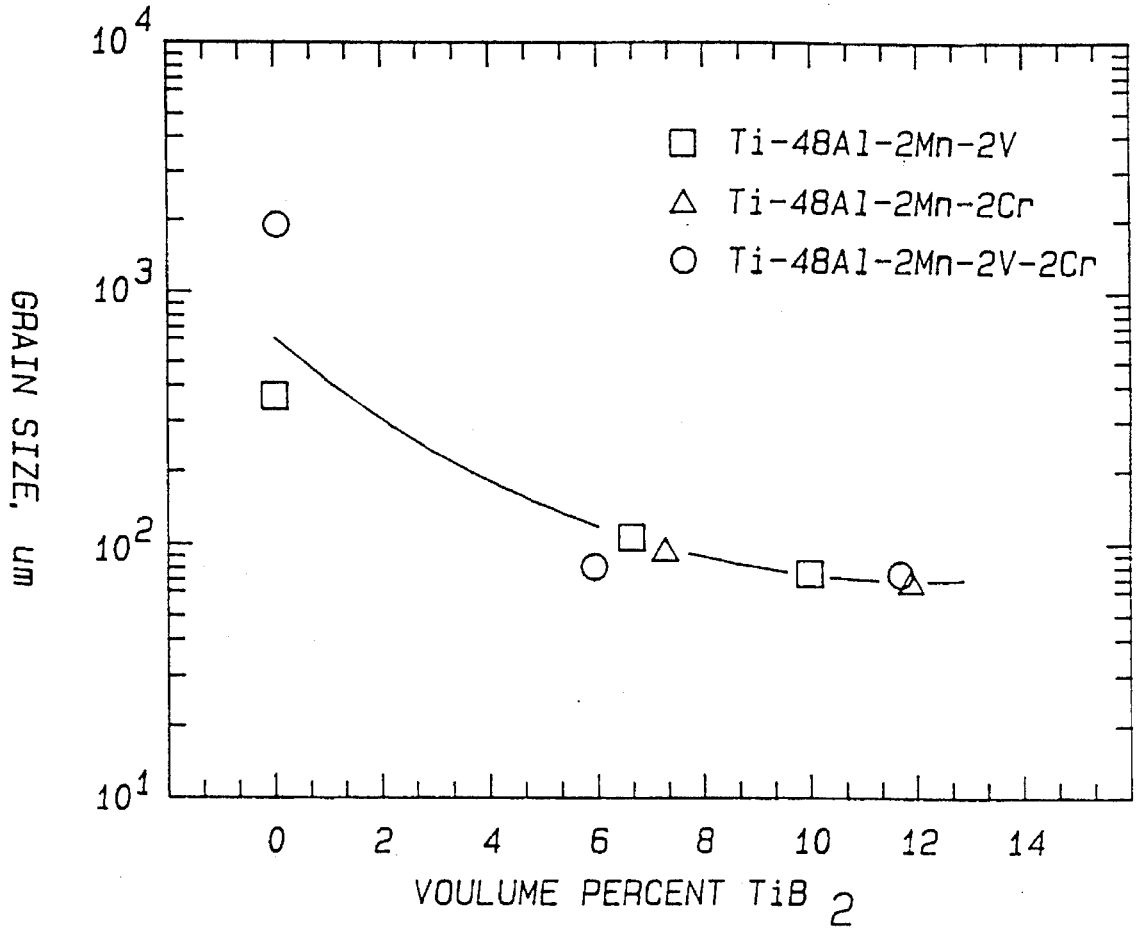
FIG. 10 illustrates the measured grain size as a function of $TiB_2$ volume % for the aforementioned alloys.

Grain size analyses were performed on the alloys that had been heat treated at 1650° F. for 16 hours to determine the effect of dispersoid loading on grain size. FIG. 10 depicts large reductions in grain size due to the inoculative effect of the $TiB_2$ dispersoids. A reduced sensitivity of grain size on dispersoid loading is apparent at higher volume fractions of dispersoids. The large variations in alloy grain size when no dispersoids are present appears to be a consequence primarily of the size and scale of the smaller, equiaxed grains that reside between large columnar, lamellar colonies.

The surprising increase in both strength and ductility of the Cr-Bearing, predominantly gamma titanium aluminides of FIG. 1 is also observed at elevated temperatures as illustrated in Table II wherein investment cast, HIP'd, and heat treated (900° C. for 50 hours) specimens were tensile tested at 816° C.

TABLE II

| Tensile Testing a 816° C. | σ (ksi) yield | σ (ksi) ult | % elong |
|---|---|---|---|
| Ti—48Al—2Mn—2Cr | 49.5 | 56.2 | 18.1 |
| Ti—48Al—2Mn—2Cr + 7 v % $TiB_2$ | 45.0 | 52.4 | 22.8 |
| Ti—48Al—2Mn—2Cr + 12 v % $TiB_2$ | 47.5 | 55.3 | 20.3 |
| Ti—47Al—2Mn—1Nb—1Cr | 51.9 | 68.0 | 4.9 |
| Ti—47Al—2Mn—1Nb—1Cr + 7% v % $TiB_2$ | 51.2 | 76.5 | 12.3 |

The creep resistance of the Ti-47Al-2Mn-1Nb- 1Cr alloy without and with 7 volume % $TiB_2$ dispersoids was evaluated at 1500° F. and 20.0 ksi load. The specimens were investment cast, HIP'ed, and heat treated at 900° C. for 50 hours. As indicated in Table III, the boride-free and boride-bearing specimens exhibited generally comparable rupture lives. The creep resistance of the Ti-47Al-2Mn-1Nb-1Cr alloy thus was not adversely affected by the inclusion of 7 volume % $TiB_2$ dispersoids.

TABLE III

| Creep Data at 1500° F./20.0 ksi | Rupture Life (hrs) |
|---|---|
| Ti—47Al—2Mn—1Nb—1Cr | 96.3/111.7 |
| Ti—47Al—2Mn—1Nb—1Cr + 7 v % $TiB_2$ | 102.8/110.7 |

In practicing the present invention, the concentration of Cr should not exceed about 5.0 atomic % of the TiAl alloy composition in order to provide the aforementioned predominantly gamma titanium aluminide matrix microstructure. For example, a TiAl ingot nominally comprising Ti-48Al-2V-2Mn-6Cr (measured composition, in atomic %, 44.1 Ti-45.8Al- 20Mn-6.2Cr-1.9V) was prepared and investment cast, HIP'ed, and heat treated as described hereinabove for the alloys of FIG. 1. The ingot included about 7.0 volume % $TiB_2$. Examination of the microstructure of the ingot before and after a 1650° F./16 hour heat treatment revealed volume fractions of beta phase well in excess of 5 volume %, primarily at grain (colony) boundaries and along lamellar interfaces. The heat treatment resulted in spherodization and a relatively homogeneous distribution of the beta phase in the microstructure. The heat treated alloy exhibited a tensile yield strength of about 90 ksi but a substantially reduced ductility at room temperature of only 0.15%.

Thus, in practicing the invention the upper limit of the Cr concentration should not exceed about 5.0 atomic % of the alloy composition. On the other hand, the lower limit of the Cr concentration should be sufficient to result in an increase in both strength and ductility when appropriate amounts of dispersoids are included in the matrix. To this end, in accordance with the present invention, the Cr concentration is preferably from about 0.5 to about 5.0 atomic % of the alloy matrix, more preferably from about 1.0 to about 3.0 atomic % of the alloy matrix.

While the invention has been described in terms of specific embodiments thereof, it is not intended to be limited thereto but rather only to the extent set forth in the following claims.

We claim:

1. A titanium aluminum alloy consisting essentially of, in atomic % about 40 to about 52% Ti, about 44 to about 52% Al, about 0.5 to about 5.0% Mn and about 0.5 to about 5.0% Cr, said alloy having second phase dispersoids therein in an amount of at least about 0.5 volume % effective to increase both alloy strength and ductility as compared to said alloy without said dispersoids.

2. A titanium aluminum alloy consisting essentially of, in atomic % about 41 to about 50% Ti, about 46 to about 49% Al, about 1 to about 3% Mn, about 1 to about 3% Cr, up to about 3% V, and up to about 3% Nb, said alloy having second phase dispersoids therein in an amount of at least about 0.5 volume % effective to increase both alloy strength and ductility as compared to said alloy without said dispersoids.

* * * * *